US005797676A

United States Patent [19]

Furlani

[11] Patent Number: 5,797,676

[45] Date of Patent: Aug. 25, 1998

[54] MOBILE CONCRETE MIXING SYSTEM TRANSPORTABLE ONTO TRUCKS

[75] Inventor: Michele Furlani, Minerbe, Italy

[73] Assignee: SIMEM S.p.A., Minerbe, Italy

[21] Appl. No.: 856,396

[22] Filed: May 14, 1997

[30] Foreign Application Priority Data

May 15, 1996 [IT] Italy ..... VR96A0045

[51] Int. Cl.[6] ..... B28C 5/20

[52] U.S. Cl. ..... 366/18; 366/28; 366/26; 414/501; 414/598

[58] Field of Search ..... 366/18, 55, 62, 366/53, 3, 6, 8, 10, 14, 15, 26, 27, 28, 30, 42, 49; 414/21, 683, 332, 501, 598

[56] References Cited

U.S. PATENT DOCUMENTS

| | | | |
|---|---|---|---|
| 3,476,270 | 11/1969 | Cox et al. | 414/21 |
| 3,905,586 | 9/1975 | Wall, Jr. | 366/18 |
| 3,938,673 | 2/1976 | Perry, Jr. | 366/18 |
| 3,986,708 | 10/1976 | Heltzel et al. | 366/17 |
| 4,619,531 | 10/1986 | Dunstan | 366/18 |
| 4,792,234 | 12/1988 | Doherty | 366/18 |
| 4,795,264 | 1/1989 | Riker | 366/28 |
| 5,411,329 | 5/1995 | Perry | 366/26 |
| 5,474,379 | 12/1995 | Perry | 366/26 |

FOREIGN PATENT DOCUMENTS

| | | |
|---|---|---|
| 0 023 338 | 2/1981 | European Pat. Off. . |
| 2 467 109 | 4/1981 | France . |
| 37 31 623 | 3/1989 | Germany . |

*Primary Examiner*—Tony G. Soohoo
*Attorney, Agent, or Firm*—Browdy and Neimark

[57] ABSTRACT

The present invention relates to a mobile concrete mixing system which substantially comprises: a feeding unit (2); a mixing unit (3); a conveyor belt; and a support structure (5) that embodies a first framework (18) supporting the conveyor belt (4), and a second framework (19) supporting the mixing unit (3). According to the present invention, the first (18) and second (19) frameworks are connected to each other by means of a hinge (22) which allows for the rotation of the first framework (18) about a substantially horizontal axis (X) in relation to the second framework (19). In this manner, a movement of the mixing unit (3) between a transporting position (23) and an operative position (24) is determined. Such a rotation about the axis (X) is obtained by keeping the mixing unit (3) in a horizontal position. In turn, by means of a mechanical actuator (27), the conveyor belt (4) is movable between a shortened condition, in the transporting position (23) of the mixing unit (3), and a lengthened condition, in the operative position (24) of said mixing unit (3).

7 Claims, 4 Drawing Sheets

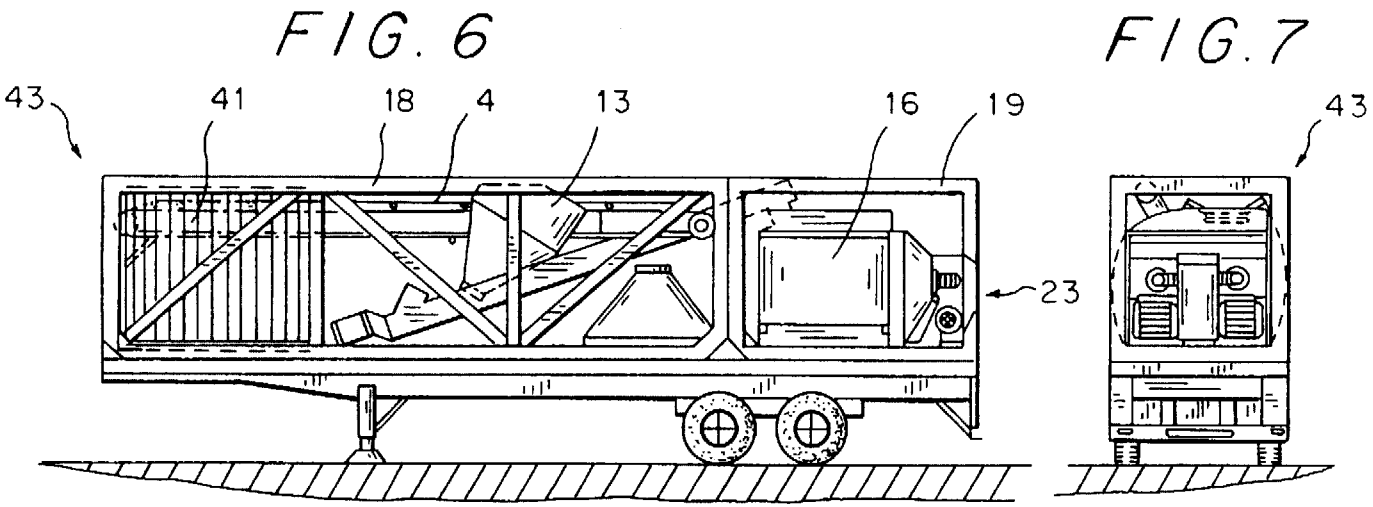
FIG. 6
FIG. 7
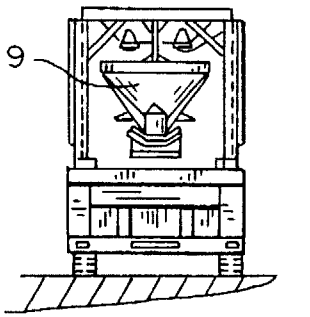
FIG. 9
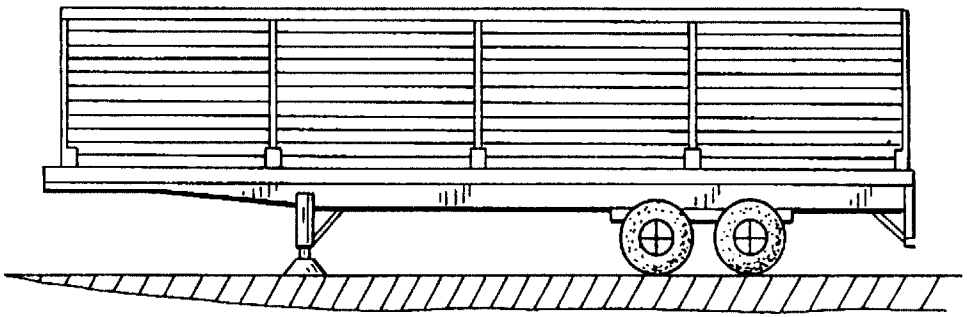
FIG. 8

MOBILE CONCRETE MIXING SYSTEM TRANSPORTABLE ONTO TRUCKS

BACKGROUND OF THE INVENTION

The present invention relates to a mobile concrete mixing system transportable onto trucks or similar vehicles, which can be used on building sites for the production of concrete.

As known, mobile concrete mixing systems transportable onto trucks are substantially comprised of an aggregate stocking unit, a mixing unit for collecting, measuring and batching the aggregate, water and cement, a loading system for transferring the aggregate from the stocking unit to the mixing unit, containment silos for the cement, which are usually equipped with screw conveyers to transport the cement to the mixing unit.

According to the type of embodiment, these systems can then be mounted for transport onto one, two or more trucks which are more or less able to fall within the normal overall dimensions of traffic obstruction provided for by current regulations concerning routine traffic circulation of trucks.

The silos and related methods of transportation do not differentiate themselves a great deal from one concrete mixing system to another, therefore, in what will follow, said silos and methods will not be discussed, and will also be excluded when taking into consideration the trucks used in the transport of the mobile concrete mixing system.

At present, and according to the known technique, there are substantially two types of mobile concrete mixing systems present on the market.

A first type of concrete mixing system (of French design) envisages the use of two trucks, of which a first truck is designated to the transport of the stocking unit, and a second truck is designated to the transport of the mixing unit and the aggregate loading system.

In particular, by means of elevating methods, the central part of the second truck slidingly moves on a supporting frame, between a lowered position, in which the truck is in a transporting condition, and a raised position, in which the mixing unit and the aggregate loading system are in an operative condition.

When the central part of the truck carrying the mixing unit is found in a raised position, the above mentioned supporting frame assumes an arched shape which allows for the passage under said central part of a concrete mixer that collects the concrete exiting the mixing unit. Although simple to install said first system, presents several drawbacks.

A first drawback is due to the fact that, in order to move the central part of the second truck, onto which the entire mixing unit is mounted, a support structure of considerable dimensions must be used which is equipped with a framework provided with legs that are positioned peripherically and externally in relation to the mixing unit. In this case, if the dimensions of the mixing unit are not to be sacrificed (for example, by envisaging the use of a mixer with a smaller capacity), to the detriment of the quantity of concrete produced, a truck of extraordinary dimension must be used, which does not fall within the normal dimensions provided for in routine traffic circulation on roads. Furthermore, said drawback implies that each time the system is to be moved from one building site to another, special permits must be requested to be able to resort to "oversized transports", wasteful in terms of both money and time.

A second drawback is due to the fact that, in order to allow for the passage of a concrete mixer under the mixing unit, the central part of the second truck must be lifted to a height which at least corresponds to the height of the concrete mixer. In this manner, the aggregate loading system, which in the type of known system described is positioned in the front part of the second truck, must overcome the difference in height between the exit from the stocking unit, (practically at ground level), and the mixing unit, all in a space of a few meters relative to only the front part of the truck. Consequently, the aggregate loading system must have a rather pronounced average inclination of about 60°. This limits the choice of aggregate loading systems employable in the use of only one bucket, usually having a skip inserted, by means of guides, into a sliding framework embodied in such a way to allow for the withdrawal of aggregate from the stocking unit and for the unloading of material in the mixing unit.

Said latter aggregate loading system proves to be extremely expensive and not simple to accomplish, having to provide for a sliding framework divided into sections which are provided with different inclinations to allow for the bucket to insert itself under the stocking unit in a substantially horizontal position, as well as to vertically position itself in the proximity of the mixing unit. In addition, moving methods for operating the bucket, and braking methods for controlling the course of the bucket, must also be associated to said bucket. It is necessary to also bear in mind that the use of a bucket which slides on guides, imposed by the use of said type of concrete mixing system, also implies a reduced flow of aggregate to the mixing unit, and consequently, a reduced quantity of concrete exiting said unit. In fact, the bucket used should be able to lift itself, without requiring the need for moving methods of extraordinary capacity, and should likewise be able to insert itself under the hopper of the stocking unit, without imposing an excessive height to said unit, in relation to the ground, which implies problems when loading the aggregate into the stocking hopper.

A second type of concrete mixing system of a known technique envisages the use of a single truck onto which the stocking unit, the mixing unit and the aggregate loading system are mounted.

Said system is comprised of a support structure divided into two frameworks: the first framework is able to support the mixing unit and the aggregate loading system; the second framework is able to support the stocking unit. Both such frameworks are hinged together in the proximity of the upstream end of the first framework (intended as the feeding direction of the aggregate) and allow for said framework to rotate about a substantially horizontal axis. The rotation of the first framework determines the movement of the mixing unit and of the aggregate loading system between an operative position, in which the mixing unit proves to be placed in a substantially horizontal position, and a transporting position, in which the mixing unit is placed on the truck in a lowered and very inclined position. Said inclined position of the mixing unit proves to be extremely encumbering, not very practical and such as to not allow the truck to fall within the provided for dimensions for normal road circulation, unless a smaller sized mixing unit is used, which clearly limits the production of concrete. Furthermore, as stated, such an inclined position is not very practical in that the oil tanks for the hydraulic gearcases and for the reduction gears of the transmission system must first be emptied. The turning over of the mixing unit, envisaged in the passage from the operative horizontal position to the inclined transporting position, also implies noticeable problems of stability for all the parts which comprise said mixing unit (among which include a cement batcher, a water proportioner and a mixer), and which must be properly secured so as to endure stress caused by the weight, as well as the direction variables, as the mixing unit begins to rotate. Therefore, it seems important to keep the position of the mixing unit always horizontal to optimize the overall dimensions, allowing the truck to fall within the provided for dimensions for normal road circulation, as well as to overcome the problems which are tied to the stability of the mixing unit.

In relation to the second type of known system, if a conveyor belt is used as a method of transport for the aggregate, the use of a considerably long truck must be envisaged which is, however, beyond the limits provided for in normal road circulation. In fact, the conveyor belt proves to be operatively efficient only with an inclination which is much less than that envisaged for the loading system having a bucket. Therefore, said conveyor belt, placed at the envisaged height for loading a bucket from above, and having to transport the aggregate up to the mixing unit, must inevitably be very long and must require a truck with a length that exceeds the usually provided for limits.

The use of a single truck used to transport the entire concrete mixing system involves the use of a relatively small stocking hopper which needs to be frequently loaded to ensure an adequate production of concrete. This fact involves a waste of time as well as operative difficulties with a consequently low production output. The reduced dimensions of the stocking hoppers impose to the same hoppers a division into compartments which is arranged as a cross shape (so as not to obtain compartments of dimensions inferior to the width of the buckets of the earthwork machines) which penalise the loading speed of the hoppers. In fact, to be able to gain access to all the compartments, an earthwork machine must, in this case, go around the stocking hopper, resulting in a consequent loss of time.

The stocking hoppers used in the second known type of concrete mixing system, not being able to exceed the length because of the limited dimensions of the truck, are more developed in height by means of the use of extendible modular panels. Due to the rapid loading process of the stocking hopper, the second known technique includes other drawbacks, such as the construction of an access ramp to allow for the buckets of the machines to reach the top of the panels of said stocking hopper.

Consequently, in relation to the known concrete mixing systems, from what is described above, an optimal mobile concrete mixing system should be able to satisfy the following requirements:

- to be able to be mounted onto two trucks, which fall within the limits provided for concerning traffic obstruction, so as not to penalise the production of concrete, with all the above mentioned problems and drawbacks tied to the use of a single truck, and so as not to restrict the transportation of the system to the problems regarding oversized transports;
- to use an aggregate loading system which falls within the normal dimensions of a truck and which is economically advantageous, meanwhile, able to guarantee any working production capacity of aggregate to the mixing unit;
- to arrange for positioning methods which allow for the housing of both the aggregate loading system and the mixing unit onto a single truck, keeping said mixing unit always in a horizontal position during the movement between the operative position and the transporting position.

SUMMARY OF THE INVENTION

Therefore, the essential aim of the present invention is to solve the above mentioned problems and drawbacks related to the known technique by providing for a mobile concrete mixing system which allows for an elevated production of concrete by using an aggregate loading system that is economically convenient and easily housed, along with the mixing unit, into the dimensions of a ordinary truck.

A further aim of the present invention is to provide for a mobile concrete mixing system equipped with a mixing unit which is movable between an operative position and a transporting position and which always remains substantially horizontal. These aims, and others besides, are all attained by the present concrete mixing system which comprises: a feeding unit; a mixing unit; a conveyor belt; a support structure comprised of a first and a second framework connected to each other by means of a hinge which determines the movement of the mixing unit between a transporting position and an operative position, keeping the mixing unit in a horizontal position.

BRIEF DESCRIPTION OF THE DRAWINGS

Further characteristics and advantages of the present invention will better emerge from the detailed description that follows, of a preferred embodiment of the invention, illustrated in the form of a non-limiting example in the accompanying drawings, in which:

FIGS. 6 and 7 respectively illustrate a lateral and rear schematic view of the concrete mixing system in FIG. 1, related to the mixing unit and the conveyor belt, which is mounted onto a truck and positioned in a transporting condition;

FIGS. 8 and 9 respectively illustrate a lateral and rear schematic view of a feeding unit of the concrete mixing system, mounted onto a truck and positioned in a transporting condition.

DETAILED DESCRIPTION OF THE PREFERRED EMBODIMENTS

Figure 1:
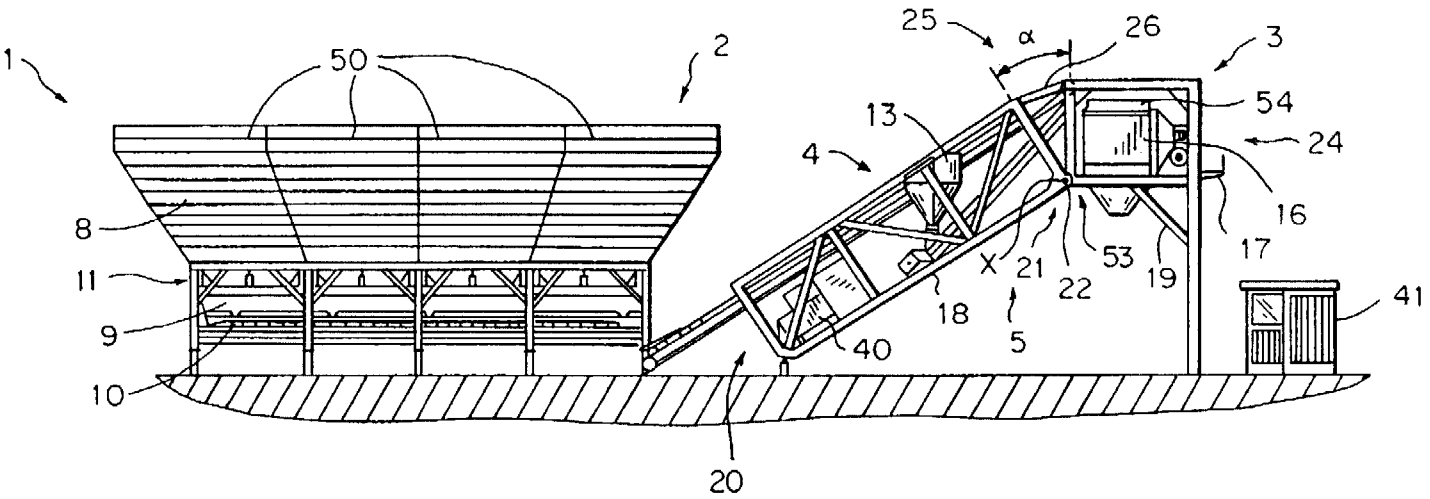
FIG. 1 shows a schematic view of the system of the present invention, in an operative condition, and a lateral view with several parts removed so as to better evidence others.
Figure 2:
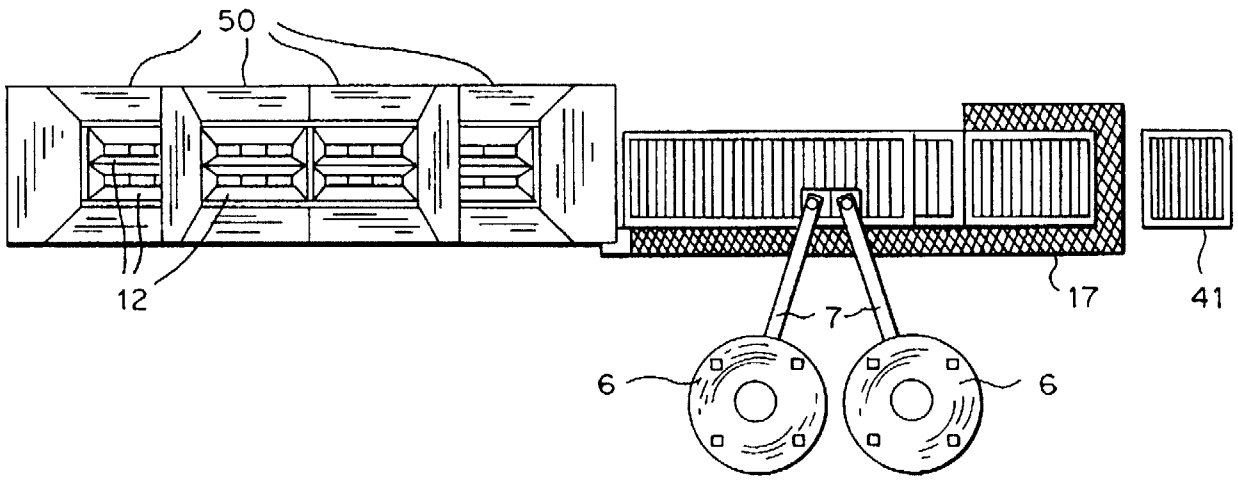
FIG. 2 shows a schematic plan view of the system in FIG. 1.

With reference to the accompanying figures, (1) denotes, as a whole, the mobile concrete mixing system of the present invention. Said system substantially comprises a feeding unit (2) for the containment, the weighing and the dispatching of the aggregate; a mixing unit (3) to collect, batch and mix the aggregate, water and cement; a conveyor belt (4) which transfers the aggregate from the feeding unit (2) to the mixing unit (3); and a support structure (5). In addition, in the concrete mixing system (1) there are envisaged silos (6) equipped with screw conveyors (7) used to transport the cement to the mixing unit (3).

The feeding unit (2) is substantially comprised of an aggregate stocking hopper (8), of a weighing hopper (9) and of a expeller belt (10) positioned below the weighing hopper (9).

The stocking hopper (8) is divided into several compartments (50) each equipped under with an expeller opening (11) equipped with a pair of proportioning doors (12) through which the weighing hopper (9) is fed.

As shown in FIGS. 8 and 9, the feeding unit (2) can be housed in a first lorry (52) whose dimensions may easily fall within the limits provided for in normal road circulation without penalising the production output of the system.

Figure 3:
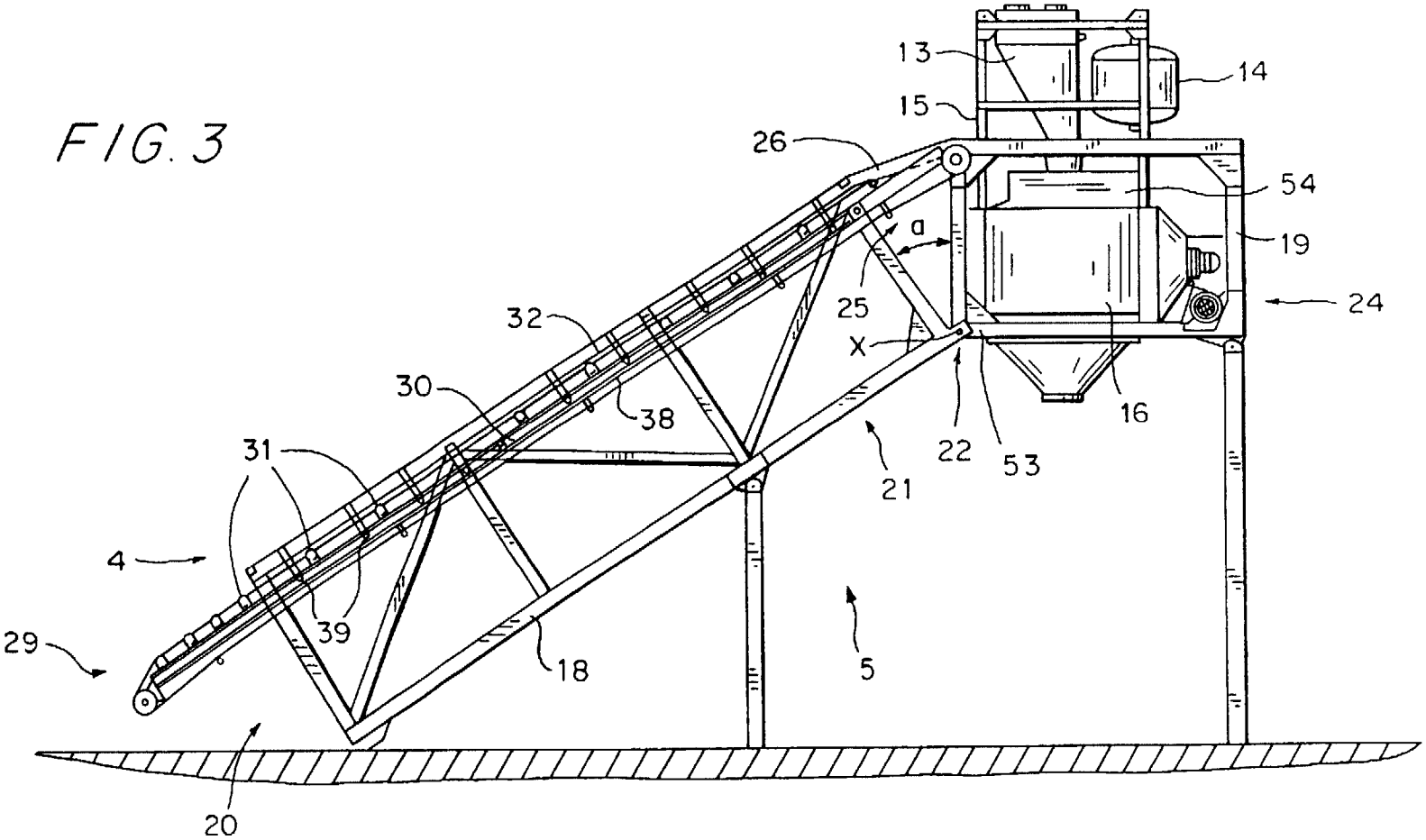
FIG. 3 illustrates an enlarged schematic view and lateral view of a section of the system in FIG. 1 (mixing unit and conveyor belt) provided with variations and with several parts removed so as to better evidence others.

The mixing unit (3) comprises a mixer (16) equipped with a cover (54), as well as a water proportioner (14) and a cement batcher (13), both mounted in a possible preferred embodiment, as shown in FIG. 3, onto a small supporting frame (15).

In the description that follows, the small supporting frame (15), to which the cover (54) of the mixer (16) is also connected, can be removed from above the mixer (16), where said frame can be located when the system (1) is in operation, and can be placed in a less encumbering position when the system is moved.

In a different preferred embodiment, the cement batcher (13) is mounted at about the middle (see FIG. 1) of the support structure (5).

The mixing unit (3) is encircled by a walkway (17) which extends along both sides of the conveyor belt (4), parallel to the latter, so as to easily allow for access to both the mixing unit (3) and the conveyor belt (4), making inspection and maintenance procedures possible. The support structure (5) is comprised of a first framework (18), supporting the conveyor belt (4), and a second framework (19), supporting the mixing unit (3). Taking into consideration the direction of the feeding motion of the aggregate as a reference, the first framework (18) is equipped with an upstream end (20), positioned in the proximity of the expeller belt (10), and a downstream end (21), positioned in the proximity of the mixing unit (3).

As shown in detail in FIGS. 1 and 3, the first and second frameworks (18,19) are connected to each other by means of a hinge (22) joining the downstream end (21) of the first framework (18) to an angular element (53) of the second framework (19). Said hinge (22) allows for the rotation about a substantially horizontal axis (X) of the first framework (18) in relation to the second framework (19). This provides for the movement of the mixing unit (3) between a transporting position (23), in which said frameworks (18 and 19) are positioned side-by-side in a minimally encumbering condition, and an operative position (24), in which said frameworks are separated by an alpha angle. The two frameworks (18 and 19) are held in the operative position (24) by means of a fastening mechanism (25), as in the example of the embodiment represented in the accompanying figures, comprised of two removable bars (26) secured to their own ends to the two frameworks (18 and 19). An important detail of the present invention is represented by the fact that the rotation about the axis (X) is obtained by keeping the mixing unit in a position which is always substantially horizontal.

The conveyor belt (4) is, in turn, movable by means of a mechanical actuator (27), between a shortened condition (28), in the transporting position (23) of the mixing unit (3), and a lengthened condition (29), in the operative position (24) of said mixing unit (3).

The conveyor belt (4) is mounted onto the first framework (18) by means of a supporting profile (30) equipped with rollers (31) for the creeping of the belt (32).

Figure 5:
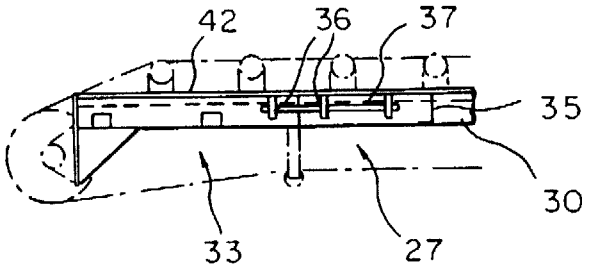
FIG. 5 illustrates a schematic view of a different preferred embodiment of a detail of the concrete mixing system related to the conveyor belt.

In a first preferred embodiment, as illustrated in FIG. 5, the supporting profile (30) presents a terminal section (33) provided with an outer profile (42) which slidingly moves on an inner profile (35) used to stretch the conveyor belt (4) and bring said belt to a lengthened condition (29). The mechanical actuator (27) comprises two engagements (36) used to activate the outer profile (42), of which one is integral to the inner profile (35), and the other is integral to the outer profile (42), splined to a thread bar (37) which can be operated by a manually activated hydraulic system, not illustrated in the figure.

In a second preferred embodiment, as illustrated in FIG. 3, the supporting profile (30) is equipped with guides (38) which slide on idle wheels (39) mounted onto the first framework (18). Therefore, the conveyor belt proves to be movable, by means 10 of a moving mechanism, not illustrated in the figure, between said shortened position (28) and said lengthened position (29) along a horizontal shift (D).

When both the first (18) and second (19) frameworks are placed in a transporting position (23), and the conveyor belt (4) is correspondingly placed in the shortened condition (28), the mixing unit (3), the support structure (5) and the conveyor belt (4) can be advantageously housed in a single second truck (43), able to fall within the normal dimensions provided for by the road traffic code for routine traffic circulation.

Figure 4:
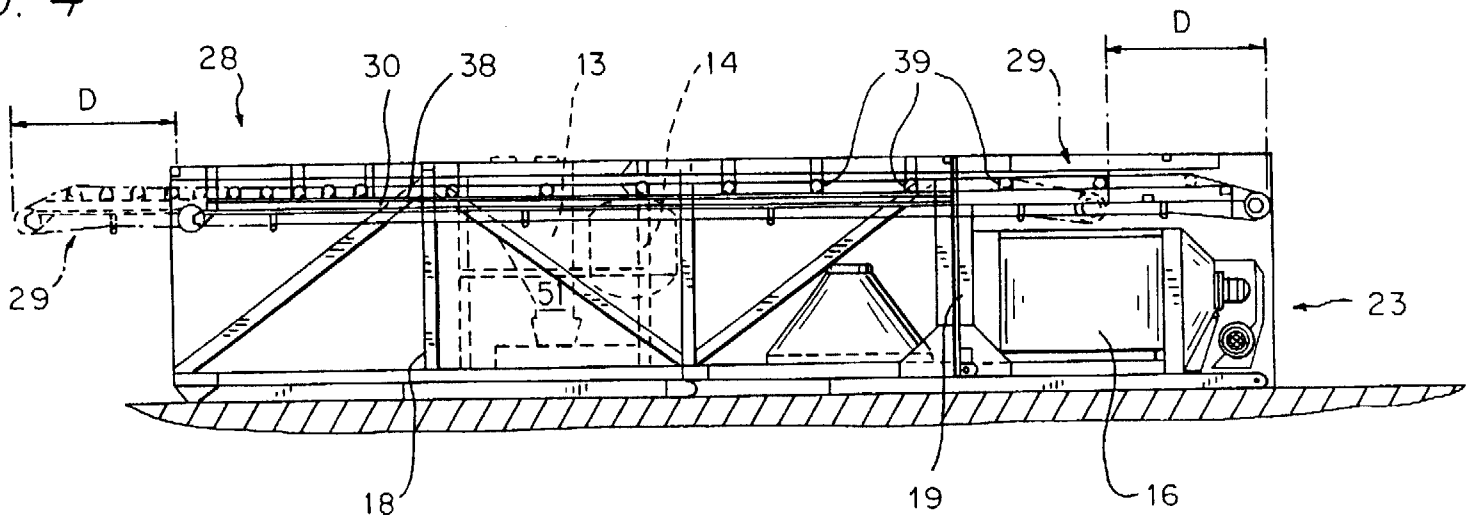
FIG. 4 illustrates a schematic view of the section of the system in FIG. 3 in a transporting condition, but not mounted onto a truck.

In said transporting position (23), with reference to a previously stated possible preferred embodiment, the small supporting frame (15) proves to be positioned in a central compartment (51) on the second truck (43) inside the first framework (18), as shown in FIG. 4, in which the small supporting frame (15) (as outlined with a broken line in the figure) is inserted and mounted in the central compartment (51) which only aims to evidence the overall dimensions.

The concrete mixing system (1) further comprises an operating unit (40) used in the movement of all the pneumatic devices (for example, the batcher and proportioner valves, the expeller doors, and so on) which is secured both, when the system is in operation, and when said system is being transported to the first framework (see FIG. 1).

As shown in FIG. 6, a control cabin (41) is also housed in the front part of the second truck (43) which allows for both the operative and functional control of the entire concrete mixing system (1). As noted in the present system, thanks to the structural configuration, said system can likewise be advantageously and easily transportable inside standard shipping containers, also by sea.

What is claimed is:

1. A mobile concrete mixing system transportable onto vehicles of a type comprises:—a feeding unit (2) substantially comprised of an aggregate stocking hopper (8), of a weighing hopper (9) and of an expeller belt (10) positioned below said weighing hopper (9);—a mixing unit (3) which collects, batches, proportions and mixes the aggregate, water and cement, encircled by a walkway (17) used for inspection and maintenance procedures;—a conveyor belt (4) which receives the aggregate from said expeller belt (10) and, in turn, carries said aggregate to the mixing unit (3);—an operating unit (40); a support structure (5) comprised of a first framework (18) supporting said conveyor belt (4), equipped with an upstream end (20) positioned in proximity to the expeller belt (10), and a downstream end (21), positioned in proximity to the mixing unit (3), and of a second framework (19) supporting said mixing unit (3);—a control cabin (41) which allows for both the operative and functional control of said concrete mixing system (1); wherein:

said first (18) and second (19) frameworks are connected to each other by means of a hinge (22), joining said downstream end (21) of said first framework (18) to said second framework (19), said hinge (22) being able to allow for the rotation of the first framework (18) about a substantially horizontal axis (X) in relation to the second framework (19), thus determining a movement of said mixing unit (3) between a transporting position (23), in which said frameworks (18,19) are positioned side-by-side in a minimally encumbering condition, and an operative position (24), in which said frameworks are separated by an angle (alpha) and held by means of a fastening mechanism (25), said rotation about the axis (X) being obtained by keeping the mixing unit (3) in a horizontal position;

said conveyor belt (4) is movable by means of a mechanical actuator (27), between a shortened condition (28), in said transporting position (23) of said mixing unit (3), and a lengthened condition (29), in said operative position (24) of said mixing unit (3);

said feeding unit (2) can be housed in a first vehicle (52) and said mixing unit (3), said conveyor belt (4), said support structure (5) and said operating unit (40) can be housed in a second vehicle (43), said first (52) and said second vehicle (43) being able to fall within the provided for dimensions for normal traffic circulation, when said mixing unit (3) is placed in said transporting position (23), and said conveyor belt (4) is, in turn, placed in said shortened condition (28).

2. A mobile concrete mixing system as claimed in claim 1, wherein said conveyor belt (4) is mounted on said first framework (18) by means of a supporting profile (30) equipped with at least one terminal section (33) provided with an outer profile (42) which slidingly moves by means of said mechanical actuator on an inner profile (35), thus determining said shortened (28) and lengthened (29) conditions.

3. A mobile concrete mixing system as claimed in claim 2, wherein, to activate the outer profile (42), said mechanical actuator (27) comprises two engagements (36), of which one is integral to said inner profile (35), and the other is integral to said outer profile (42), splined to a thread bar (37).

4. A mobile concrete mixing system as claimed in claim 1, wherein said conveyor belt (4) is mounted on said first framework (18) by means of a supporting profile (30) which slides on idle wheels (39), thus providing for the movement of the conveyor belt (4) along a horizontal shift (D) between said two shortened (28) and lengthened (29) conditions.

5. A mobile concrete mixing system as claimed in claim 1, wherein said second framework (19) comprises a small supporting frame (15) connected to a cement batcher (13), to a water proportioner (14) and to a cover (54) of a mixer (16), said small supporting frame (15) can be housed on said second vehicle (53) inside said first framework (18) when said mixing unit (3) is placed in a transporting position (23), and, correspondingly, said conveyor belt (4) is placed in said shortened condition (28).

6. A mobile concrete mixing system as claimed in claim 1, wherein said walkway (17) extends from said mixing unit (3) along at least one side of said conveyor belt (4), and parallel to said belt, in this manner, allowing to easily access said conveyor belt (4), making inspection and maintenance procedures possible.

7. A mobile concrete mixing system as claimed in claim 1, wherein said fastening methods are comprised of at least one removable bar (26) which securely connects said first (18) and second (19) frameworks to each other.

* * * * *